US010415510B2

(12) United States Patent
Wakamatsu et al.

(10) Patent No.: US 10,415,510 B2
(45) Date of Patent: Sep. 17, 2019

(54) FUEL VAPOR RECOVERY APPARATUS

(71) Applicant: AISAN KOGYO KABUSHIKI KAISHA, Obu-shi, Aichi-ken (JP)

(72) Inventors: Keisuke Wakamatsu, Anjo (JP); Katsuhiko Makino, Aichi-ken (JP); Atsushi Sugimoto, Obu (JP)

(73) Assignee: AISAN KOGYO KABUSHIKI KAISHA, Obu-Shi, Aichi-Ken (JP)

( * ) Notice: Subject to any disclaimer, the term of this patent is extended or adjusted under 35 U.S.C. 154(b) by 0 days.

(21) Appl. No.: 14/962,140

(22) Filed: Dec. 8, 2015

(65) Prior Publication Data

US 2016/0186698 A1 Jun. 30, 2016

(30) Foreign Application Priority Data

Dec. 25, 2014 (JP) ..... 2014-262878

(51) Int. Cl.
*F02M 25/08* (2006.01)

(52) U.S. Cl.
CPC ..... *F02M 25/0836* (2013.01); *F02M 25/089* (2013.01); *F02M 2025/0863* (2013.01)

(58) Field of Classification Search
CPC ..... F02M 25/0836; F02M 25/089; F02M 2025/0863
See application file for complete search history.

(56) References Cited

U.S. PATENT DOCUMENTS 3,610,220 A * 10/1971 Yamada ..... B60K 15/03504 123/518
4,643,635 A * 2/1987 Leachman, Jr. ..... F02M 37/18 415/1
5,257,145 A * 10/1993 Kanazawa ..... G02B 7/02 359/811
5,275,145 A * 1/1994 Tuckey ..... F02M 37/10 123/456
5,560,075 A * 10/1996 Jankowski ..... A47L 5/365 15/327.2

(Continued)

FOREIGN PATENT DOCUMENTS

CN 1975171 A 6/2007
CN 102312756 A 1/2012

(Continued)

OTHER PUBLICATIONS

Japanese Office Action dated Dec. 11, 2017, for Japanese Application No. 2014-262878 (3 p.).

(Continued)

*Primary Examiner* — Joseph J Dallo
*Assistant Examiner* — Kurt Philip Liethen
(74) *Attorney, Agent, or Firm* — Conley Rose, P.C.

(57) ABSTRACT

A fuel vapor recovery apparatus includes an adsorbent canister capable of capturing fuel vapor produced in a fuel tank, a purge passage connecting the adsorbent canister to an intake passage of an engine, and a purge pump for delivering fuel vapor from the adsorbent canister to the intake passage via the purge passage. The purge pump has a pump part and a motor part configured to drive the pump part. The fuel vapor recovery apparatus further includes a prevention mechanism for preventing liquid fuel liquefied from the fuel vapor in the purge passage from entering the motor part through the pump part.

10 Claims, 8 Drawing Sheets

(56) References Cited

U.S. PATENT DOCUMENTS

| | | | | |
|---|---|---|---|---|
| 6,014,958 | A * | 1/2000 | Miwa | F02D 41/0032 123/516 |
| 6,412,277 | B2 * | 7/2002 | Hagen | B60T 13/46 123/520 |
| 6,589,319 | B2 | 7/2003 | Ikuma et al. | |
| 6,659,087 | B1 * | 12/2003 | Reddy | F02D 41/0045 123/357 |
| 6,993,957 | B2 | 2/2006 | Kano et al. | |
| 7,828,509 | B2 * | 11/2010 | Morris | F02M 37/045 415/145 |
| 2004/0255912 | A1 * | 12/2004 | Veinotte | F02B 23/104 123/520 |
| 2011/0166765 | A1 | 7/2011 | DeBastos et al. | |
| 2012/0085325 | A1 | 4/2012 | Makino et al. | |
| 2013/0081600 | A1 | 4/2013 | Fukui et al. | |
| 2013/0240281 | A1 * | 9/2013 | Inaoka | B62J 37/00 180/219 |
| 2014/0318504 | A1 * | 10/2014 | Pearce | F02M 33/025 123/518 |

FOREIGN PATENT DOCUMENTS

| | | | | |
|---|---|---|---|---|
| CN | 102933830 | A | 2/2013 | |
| JP | H08-158958 | A | 6/1996 | |
| JP | H1130158 | A | 2/1999 | |
| JP | 2000-303918 | A | 10/2000 | |
| JP | 2002-285919 | A | 10/2002 | |
| JP | 2004232521 | A | 8/2004 | |
| JP | 2006-070768 | A | 3/2007 | |
| JP | 2007-177728 | A | 7/2007 | |
| JP | 2007-205231 | A | 8/2007 | |
| JP | 2012-82751 | A | 4/2012 | |
| WO | WO 8903715 | A1 * | 5/1989 | B01D 1/305 |

OTHER PUBLICATIONS

English Translation of Japanese Office Action dated Dec. 11, 2017, for Japanese Application No. 2014-262878 (3 p.).

Chinese Office Action dated Jul. 3, 2018, for Chinese Patent Application No. 201510809013.8 (14 pp.).

Chinese Office Action dated Oct. 30, 2018, for Chinese Patent Application No. 201510809013.8 (17 pp.).

Japanese Office Action dated Mar. 30, 2018, for Japanese Application No. 2014-262878 (3 p.).

English Translation of Japanese Office Action dated Mar. 30, 2018, for Japanese Application No. 2014-262878 (3 p.).

* cited by examiner

FUEL VAPOR RECOVERY APPARATUS

CROSS-REFERENCE TO RELATED APPLICATIONS

This application claims priority to Japanese patent application serial number 2014-262878, filed Dec. 25, 2014, the contents of which are incorporated herein by reference in their entirety for all purposes.

STATEMENT REGARDING FEDERALLY SPONSORED RESEARCH OR DEVELOPMENT

Not applicable.

BACKGROUND

This disclosure relates to a fuel vapor recovery apparatus including an adsorbent canister capable of capturing fuel vapor produced in a fuel tank, a purge passage connecting the adsorbent canister to an intake passage of an internal combustion engine, and a purge pump for delivering the fuel vapor from the adsorbent canister to the intake passage via the purge passage.

Referring to FIG. 1, Japanese Laid-Open Patent Publication No. 2007-177728 discloses a conventional fuel vapor recovery apparatus including an adsorbent canister 100, a vapor passage 104 communicating the adsorbent canister 100 with a fuel tank 103, a purge passage 106 communicating the adsorbent canister 100 with an intake passage 110 of an engine, and an atmospheric passage 107 for introducing the atmospheric air into the adsorbent canister 100. The adsorbent canister 100 is filled with an adsorbent 101 such as activated carbon, which is capable of removably adsorbing fuel vapor. The purge passage 106 is provided with a purge valve 106*v* and a purge pump 106*p*. The purge valve 106*v* is opened and closed for controlling fluid communication through the purge passage 106. The atmospheric passage 107 is provided with an atmospheric valve 107*v* for controlling fluid communication through the atmospheric passage 107. When the purge valve 106*v* of the purge passage 106 and the atmospheric valve 107*v* of the atmospheric passage 107 are closed, the fuel vapor flows through the vapor passage 104 from the fuel tank 103 to the adsorbent canister 100 and is adsorbed on the adsorbent 101. When the purge valve 106*v* of the purge passage 106 and the atmospheric valve 107*v* of the atmospheric passage 107 are opened and the purge pump 106*p* is driven, the adsorbent canister 100 is purged with the atmospheric air so as to desorb the fuel vapor from the adsorbent 101. Then, the air and the fuel vapor are introduced into the intake passage 110 of the engine.

The fuel vapor recovery apparatus of Japanese Laid-Open Patent Publication No. 2007-177728 has the purge pump 106*p* provided at the purge passage 106. Generally, the purge pump 106*p* is located near the intake passage 110 of the engine and is placed in an engine room of a vehicle. Whereas, the adsorbent canister 100 is located near the fuel tank 103 and is placed below a floor of the vehicle or the like. Because the adsorbent canister 100 is distant from the purge pump 106*p*, the fuel vapor cools and may become liquid while flowing through the purge passage 106 from the adsorbent canister 100 to the purge pump 106*p*. Thus, there is a possibility that liquid fuel liquefied from the fuel vapor in the purge passage 106 flows into a pump part of the purge pump 106*p*, and then intrudes into a motor part configured to drive the pump part. The intrusion of the liquid fuel into the motor part may cause failure of the purge pump 106*p*. Therefore, there has been a need for an improved fuel vapor recovery apparatus.

BRIEF SUMMARY

In one aspect of this disclosure, a fuel vapor recovery apparatus includes an adsorbent canister capable of capturing fuel vapor produced in a fuel tank, a purge passage connecting the adsorbent canister to an intake passage of an engine, and a purge pump for delivering fuel vapor from the adsorbent canister to the intake passage via the purge passage. The purge pump has a pump part and a motor part configured to drive the pump part. The fuel vapor recovery apparatus further includes a prevention mechanism for preventing liquid fuel liquefied from the fuel vapor in the purge passage from entering the motor part through the pump part.

According to this aspect of the disclosure, the fuel vapor recovery apparatus prevents the liquid fuel from intruding into the motor part of the purge pump so as to prevent failure of the purge pump.

DETAILED DESCRIPTION

Each of the additional features and teachings disclosed above and below may be utilized separately or in conjunction with other features and teachings to provide improved fuel vapor recovery apparatuses. Representative examples, which utilize many of these additional features and teachings both separately and in conjunction with one another, will now be described in detail with reference to the attached drawings. This detailed description is merely intended to teach a person of skilled in the art further details for practicing preferred aspects of the present teachings and is not intended to limit the scope of the invention. Only the claims define the scope of the claimed invention. Therefore, combinations of features and steps disclosed in the following detailed description may not be necessary in the broadest sense, and are instead taught merely to particularly describe representative examples. Moreover, various features of the representative examples and the dependent claims may be combined in ways that are not specifically enumerated in order to provide additional useful embodiments of the present teachings.

A fuel vapor recovery apparatus 20 in a first example will be described in reference to FIGS. 2-4. The fuel vapor recovery apparatus 20 is combined with an engine system 10 of a vehicle as viewed in FIGS. 2 and 3 and is configured to prevent fuel vapor produced in a fuel tank 15 from flowing into the atmosphere.

Figure 1:
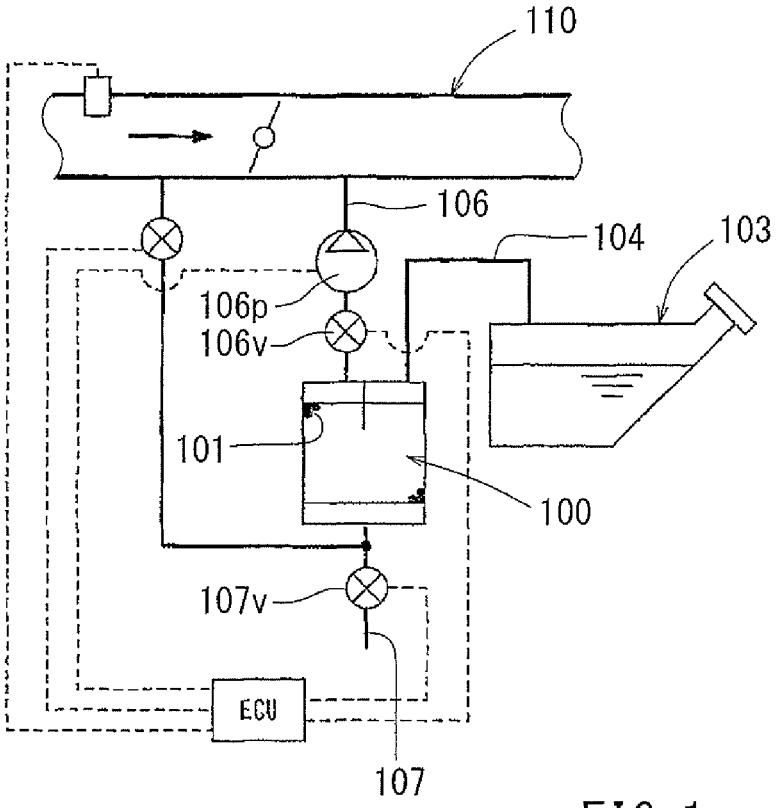
FIG. 1 PRIOR ART
FIG. 1 is a schematic diagram of a conventional fuel vapor recovery apparatus.
Figure 2:
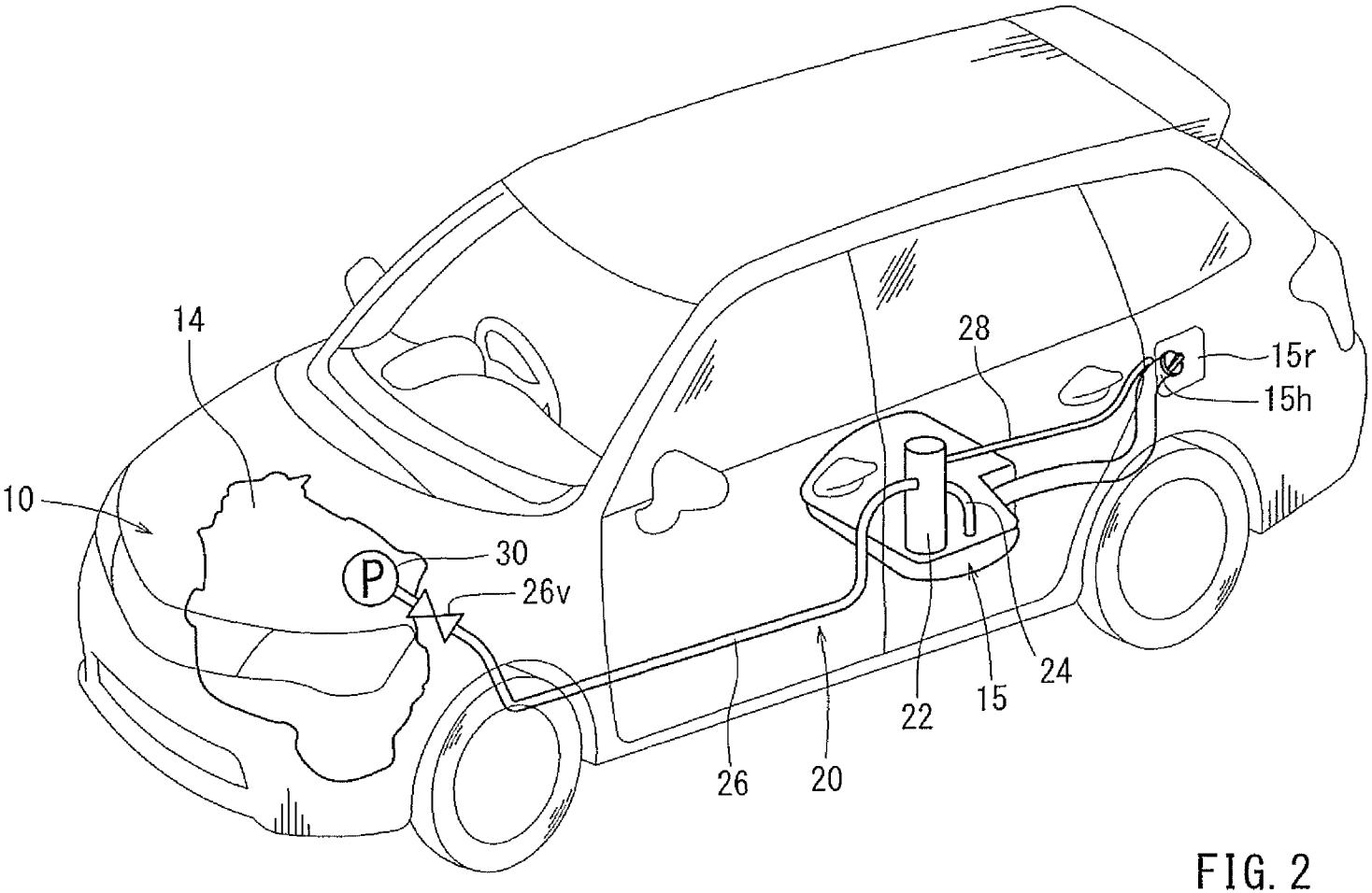
FIG. 2 is a perspective view of a vehicle equipped with a fuel vapor recovery apparatus in a first example.
Figure 3:
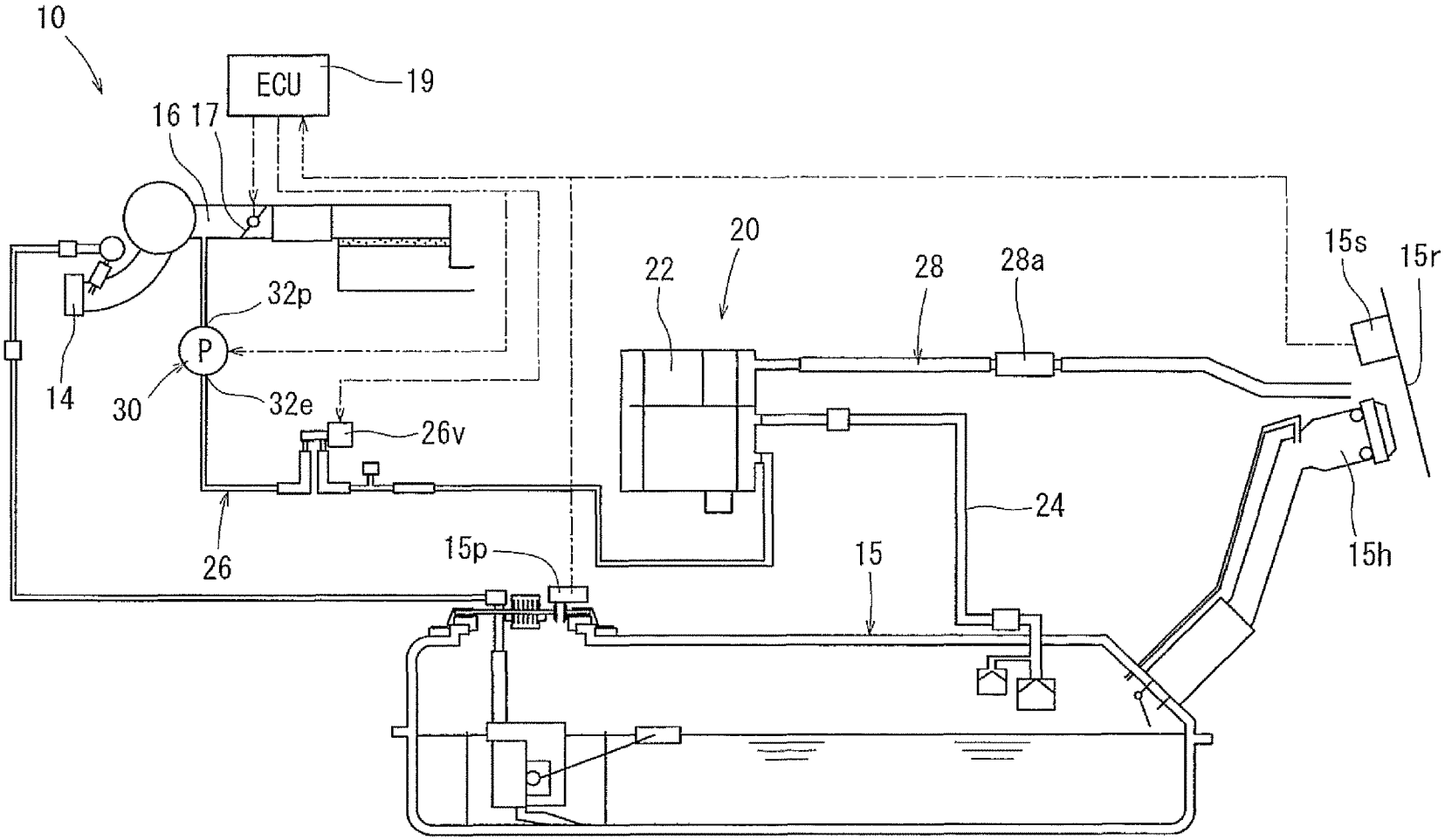
FIG. 3 is a schematic diagram of the fuel vapor recovery apparatus.

The fuel vapor recovery apparatus 20 includes an adsorbent canister 22, a vapor passage 24 connected to the adsorbent canister 22, a purge passage 26, and an atmospheric passage 28 as viewed in FIG. 3. The adsorbent canister 22 is filled with an adsorbent (not shown) such as activated carbon for capturing the fuel vapor produced in the fuel tank 15. The vapor passage 24 has one end communicating with a gas space in the fuel tank 15 and the other end communicating with the adsorbent canister 22. The adsorbent canister 22 is located near the fuel tank 15 and is placed below a floor of the vehicle as viewed in FIG. 2.

The purge passage 26 has one end connected to the adsorbent canister 22 and the other end connected to an intake passage 16 of an internal combustion engine 14 (referred to as "engine", hereinafter) downstream of a throttle valve 17. The purge passage 26 is provided with a purge valve **26*v* and a purge pump 30. The purge valve 26*v* is opened and closed for controlling fluid communication through the purge passage 26. When the purge pump 30 is driven, the atmospheric air is drawn into the adsorbent canister 22 via the atmospheric passage 28 for removing the fuel vapor from the adsorbent canister 22 and delivering the fuel vapor from the adsorbent canister 22 to the intake passage 16 of the engine 14 via the purge passage 26. The purge valve 26*v* and the purge pump 30 are operated based on signals output from an engine control unit (ECU) 19. The purge valve 26*v* and the purge pump 30 are located near the engine 14 within an engine room of the vehicle as viewed in FIG. 2. The atmospheric passage 28 is provided with an air filter 28*a* and has one end connected to the adsorbent canister 22 and the other end open to the atmosphere at a position near a fuel filler port 15*h* of the fuel tank 15 as viewed in FIG. 3**.

The fuel filler port **15*h* is located inside and near a surface panel of the vehicle and is covered with an openable lid 15*r* as viewed in FIG. 2. The lid 15*r* is provided with a lid switch 15*s* for detecting an open state and a closed state of the lid 15*r* as viewed in FIG. 3. The lid switch 15*s* outputs signals to the ECU 19. The ECU 19 also receives signals output from a tank pressure sensor 15*p* configured to detect pressure in the fuel tank 15**.

When the engine 14 is stopped by turning off an ignition switch, the ECU 19 closes the purge valve **26*v* for blocking the fluid communication through the purge passage 26 and stops the purge pump 30. In this condition, the fuel vapor is introduced from the fuel tank 15 into the adsorbent canister 22 via the vapor passage 24 and is adsorbed on the adsorbent. In addition, the fuel vapor recovery apparatus 20 is also controlled such that the fuel vapor produced in the fuel tank 15 is introduced into the adsorbent canister 22 via the vapor passage 24 when fueling to the fuel tank 15, i.e., when the lid 15*r* is opened and the lid switch 15*s*** is turned on.

After the engine 14 is started by turning on the ignition switch, when predetermined purge conditions are satisfied, the ECU 19 starts a purge operation for desorbing the fuel vapor from the adsorbent filled in the adsorbent canister 22. During this operation, the purge valve **26*v* is opened for allowing the fluid communication through the purge passage 26 and the purge pump 30 is driven. Thus, the pressure in the adsorbent canister 22 communicating with the purge passage 26 becomes negative, so that the ambient air flows into the adsorbent canister 22 via the atmospheric passage 28. The adsorbent canister 22 is purged with the air, so that the fuel vapor is desorbed from the adsorbent. The fuel vapor desorbed from the adsorbent flows through the purge passage 26 to the purge pump 30 together with the air. Then, the purge pump 30 pumps the fuel vapor and the air to the intake passage 16 of the engine 14 so as to burn the fuel vapor in the engine 14** with the air.

As viewed in FIG. 2, the adsorbent canister 22 is distant from the engine 14 (the intake passage 16), the purge valve **26*v* and the purge pump 30, which are placed in the engine room. Thus, the fuel vapor cools while flowing through the purge passage 26 from the adsorbent canister 22 toward the intake passage 16 of the engine 14, so that a part of the fuel vapor may become liquid. The liquid fuel derived from the fuel vapor (simply referred to as "liquid fuel", hereinafter) may flow through the purge passage 26 and reach a pump part 32 of the purge pump 30. The purge pump 30 is configured for preventing the liquid fuel from intruding into a motor part 36 of the purge pump 30 from the pump part 32 and/or for preventing the liquid fuel from flowing into the pump part 32**.

Figure 4:
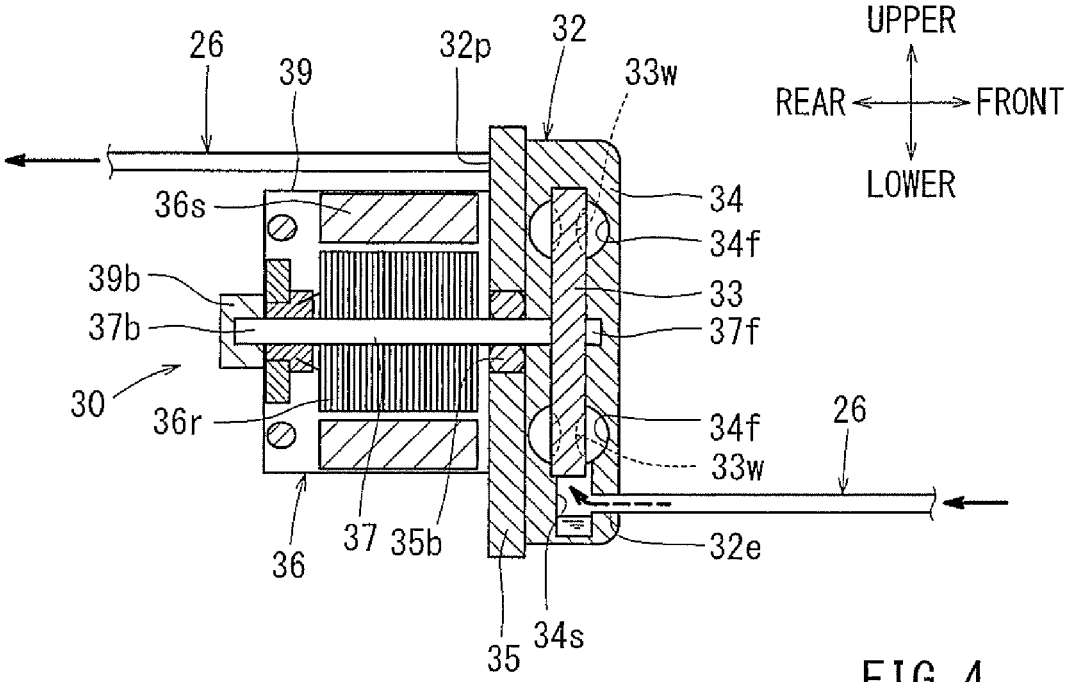
FIG. 4 is a cross-sectional view of a purge pump of the fuel vapor recovery apparatus.

FIG. 4 shows a cross-sectional view of the purge pump 30. Here, for convenience of explanation, directions of the purge pump 30 are defined based on thin directional arrows shown in FIG. 4 (showing the "upper," "lower," "rear," and "front" directions). In addition, thick arrows show a flow direction of the fuel vapor. The purge pump 30 is composed of the pump part 32 and the motor part 36, which is configured to drive the pump part 32, as viewed in FIG. 4. The pump part 32 includes an impeller 33 and a housing 34. The impeller 33 is formed in a circular plate shape and is configured to rotate about its axis. The housing 34 houses the impeller 33 therein such that the impeller 33 can rotate in the housing 34. The impeller 33 has a plurality of blade parts **33*w* at circumferential edges of its front and rear faces such that the blade parts 33*w* are arranged at regular intervals in the circumferential direction. The housing 34 defines flow passages 34*f* each extending in a circular arc shape such that the flow passages 34*f* face the blade parts 33*w* formed at the front face and the rear face of the impeller 33, respectively. The housing 34 has a pump inlet 32*e* and a pump outlet 32*p*. The pump inlet 32*e* is connected with one end of each flow passage 34*f*, whereas the pump outlet 32*p* is connected with the other end of each flow passage 34*f* Further, the housing 34 has a liquid storage part 34*s* for reserving the liquid fuel such that the liquid storage part 34*s* is in a fluid communication with both the pump inlet 32*e* and the flow passages 34*f* and is located below the flow passages 34*f***.

The impeller 33 of the pump part 32 is concentrically fixed on a front end **37*f* of an output shaft 37 of the motor part 36 such that the impeller 33 cannot rotate relative to the output shaft 37. As shown in FIG. 4, the motor part 36 includes a flange part 35 coupled with the housing 34 of the pump part 32. The flange part 35 includes a bearing 35*b* supporting the output shaft 37 of the motor part 36 at the center. The motor part 36 includes a stator 36*s* and a rotor 36*r*. The stator 36*s* is formed in a cylindrical shape, whereas the rotor 36*r* is concentrically housed in the stator 36*s* and has the output shaft 37. The stator 36*s* and the rotor 36*r* are housed in a motor housing 39, which is formed in a cylindrical shape. The motor housing 39 is concentrically fixed to the flange part 35 and has a bearing part 39*b*** supporting a rear end 37*b* of the output shaft 37 of the rotor 36*r* at its rear end surface parallel to the flange part 35.

As shown in FIG. 3, the pump inlet 32*e* of the pump part 32 of the purge pump 30 is connected with the purge passage 26 on the purge valve 26*v* side, and the pump outlet 32*p* of the pump part 32 is connected with the purge passage 26 on the intake passage 16 side. When power is fed to the motor part 36 of the purge pump 30, the rotor 36*r* of the motor part 36 rotates, thereby rotating the impeller 33 of the pump part 32. As a result, the fuel vapor and the air flowing into the pump inlet 32*e* of the pump part 32 from the purge passage 26 on the purge valve 26*v* side are forced into the flow passages 34*f* by the blade parts 33*w* of the impeller 33 such that the fuel vapor and the air are pressurized during moving along the flow passages 34*f* in the housing 34 and are discharged from the pump outlet 32*p* of the pump part 32. The fuel vapor and the air discharged from the pump outlet 32*p* of the pump part 32 are delivered to the intake passage 16 of the engine 14 through the purge passage 26. In a case that a part of the fuel vapor becomes liquid while flowing from the adsorbent canister 22 to the purge pump 30 and the liquid fuel enters the pump inlet 32*e* of the pump part 32, the liquid fuel flows into the liquid storage part 34*s* from the pump inlet 32*e* and remains in the liquid storage part 34*s*. Thus, the liquid fuel does not flow into the flow passages 34*f* of the pump part 32, so that the liquid fuel does not intrude into the motor housing 39 via the output shaft 37 of the rotor 36*r* of the motor part 36.

Figure 5:
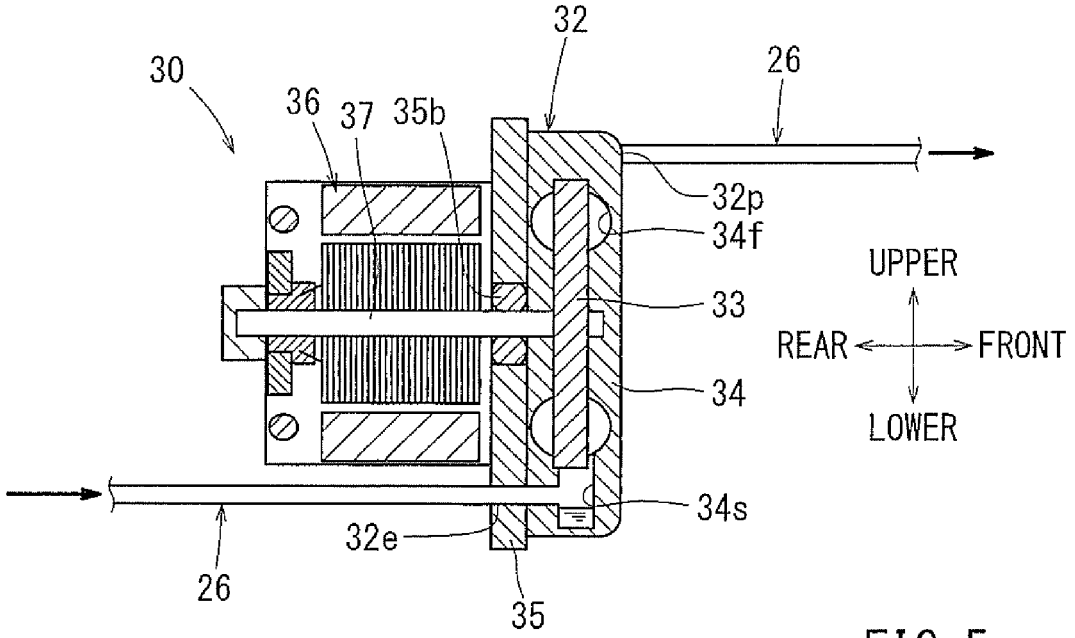
FIG. 5 is a cross-sectional view of the purge pump in a second example.

The fuel vapor recovery apparatuses 20 of other examples will be described in reference to the drawings. Because each of the following examples generally corresponds to the first example, only the differences between the first example and each of the following examples, and the same or shared configurations will not be described again. In the purge pump 30 of the first example shown in FIG. 4, the pump inlet 32*e* of the pump part 32 is located at a position distant from the motor part 36, and the pump outlet 32*p* of the pump part 32 is formed at the flange part 35. By contrast, in the purge pump 30 of a second example shown in FIG. 5, the pump inlet 32*e* of the pump part 32 is formed at the flange part 35, and the pump outlet 32*p* of the pump part 32 is located at a position distant from the motor part 36. In this example, because the pump part 32 has the liquid storage part 34*s* that communicates with both the pump inlet 32*e* and the flow passages 34*f* and is formed below the flow passages 34*f*, the intrusion of the liquid fuel into the motor part 36 can be prevented.

Figure 6:
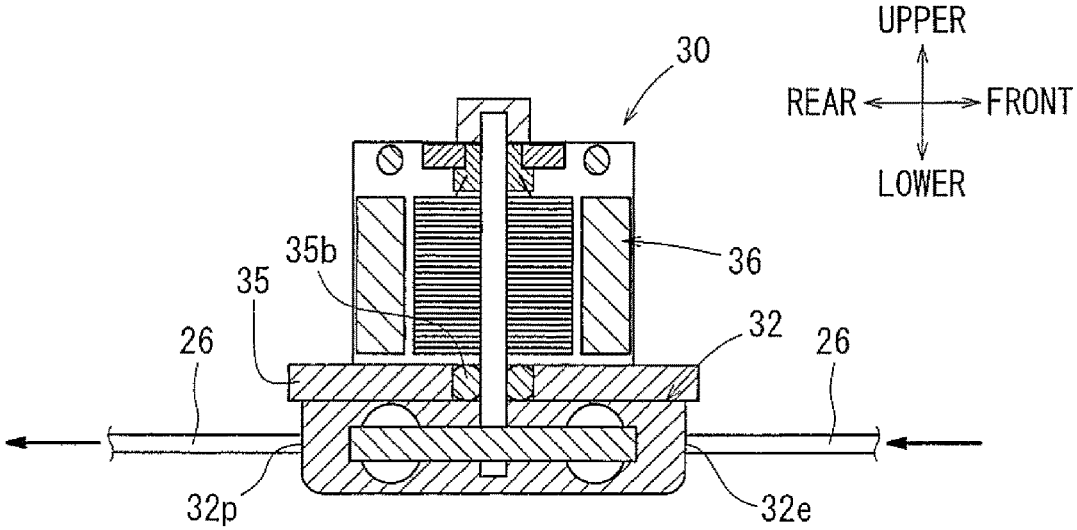
FIG. 6 is a cross-sectional view of the purge pump in a third example.

FIG. 6 shows the purge pump 30 of a third example where the pump part 32 does not include the liquid storage part 34*s*. However, in the third example, the motor part 36 is located above the pump part 32 for preventing the liquid fuel from intruding into the motor part 36.

Figure 7:
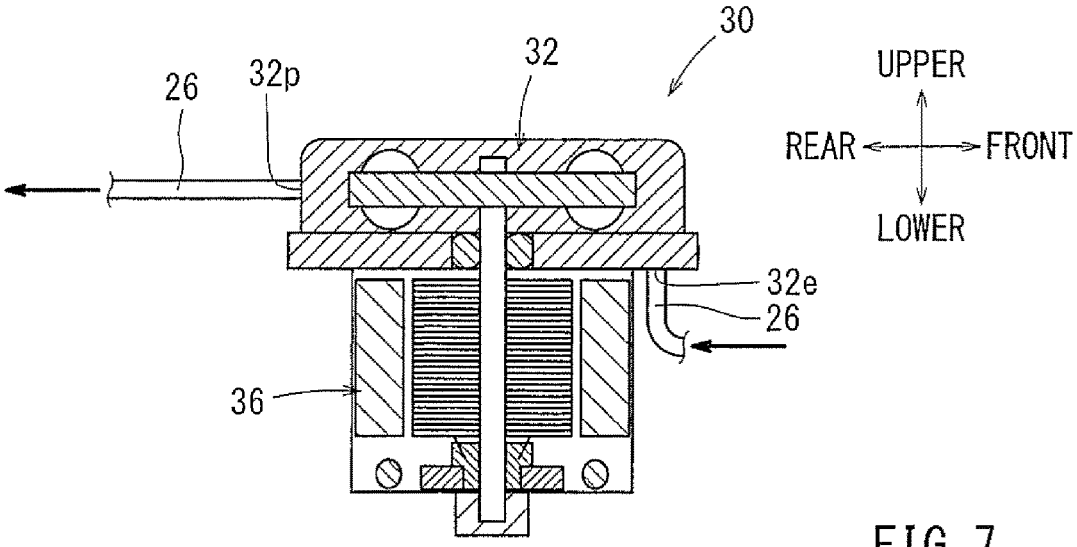
FIG. 7 is a cross-sectional view of the purge pump in a fourth example.

FIG. 7 shows the purge pump 30 of a fourth example where the pump part 32 does not include the liquid storage part 34*s* and where the motor part 36 is located below the pump part 32. In this example, the pump inlet 32*e* is directed downward. The end of the purge passage 26, which is connected to the pump inlet 32*e*, is directed upward. Thus, the liquid fuel does not flow into the pump part 32 of the purge pump 30 from the purge passage 26.

Figure 8:
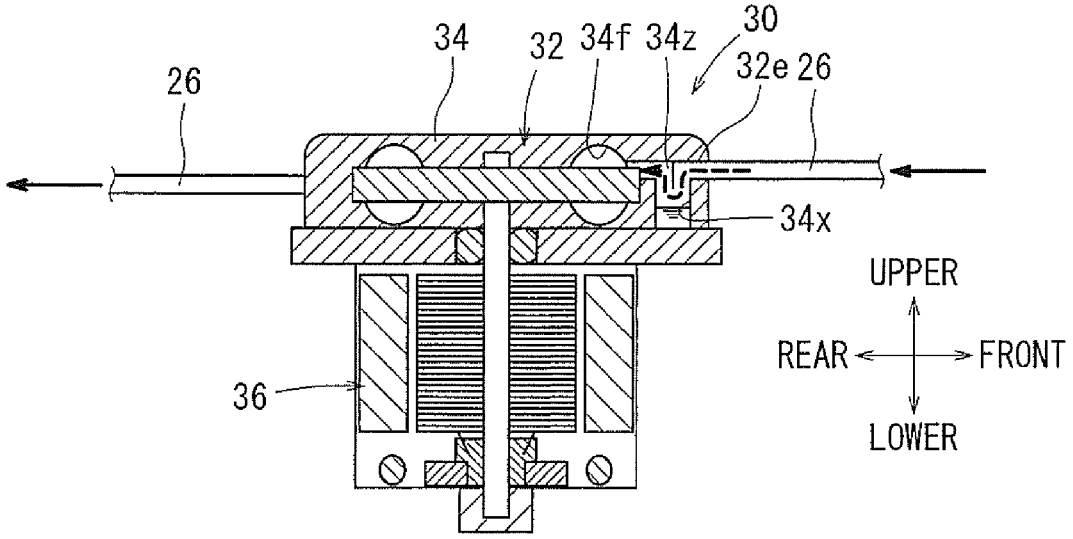
FIG. 8 is a cross-sectional view of the purge pump in a fifth example.

FIG. 8 shows the purge pump 30 of a fifth example where the motor part 36 is located below the pump part 32. In this example, the housing 34 of the pump part 32 defines therein an inflow chamber 34*x* in a fluid communication with the pump inlet 32*e*. Further, the housing 34 of the pump part 32 has an introduction passage 34*z* extending from an upper section of the inflow chamber 34*x* to the flow passages 34*f*. Thus, when mixture of the fuel vapor and the liquid fuel flows into the inflow chamber 34*x*, the fuel vapor flows through the introducing passage 34*z* from the inflow chamber 34*x* to the flow passages 34*f*, whereas the liquid fuel accumulates on the bottom of the inflow chamber 34*x* and does not flow into the flow passages 34*f*.

Figure 9:
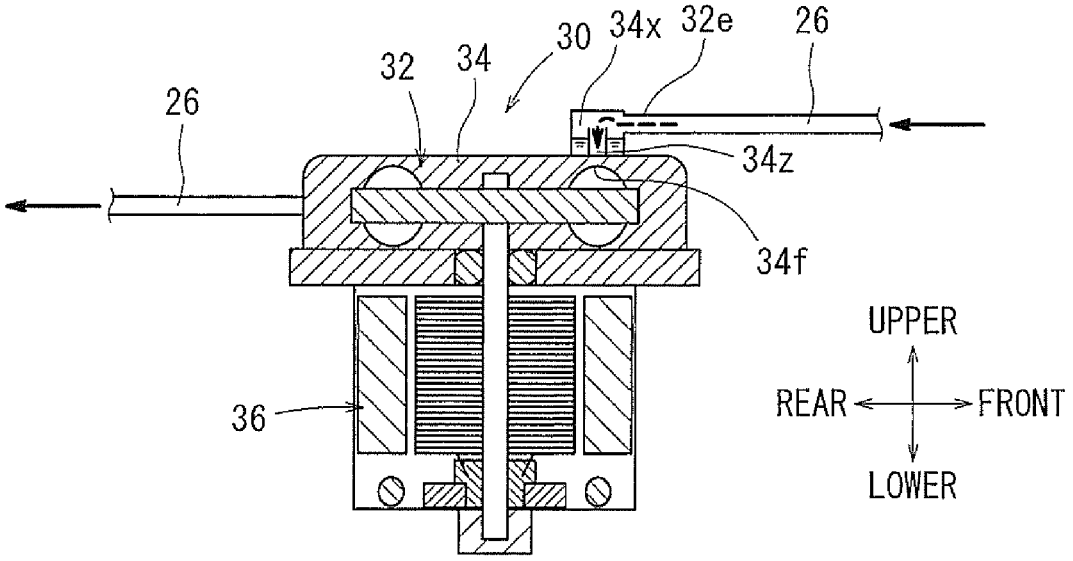
FIG. 9 is a cross-sectional view of the purge pump in a sixth example.

FIG. 9 shows the purge pump 30 of a sixth example where the motor part 36 is located below the pump part 32. In this example, the pump part 32 has the inflow chamber 34*x* and the introduction passage 34*z* outside the housing 34 of the pump part 32. The introduction passage 34*z* extends from the upper section of the inflow chamber 34*x* to the flow passages 34*f* Thus, when the liquid fuel flows into the inflow chamber 34*x*, the liquid fuel accumulates on the bottom of the inflow chamber 34*x* and does not flow into the flow passages 34*f*.

According to the fuel vapor recovery apparatus 20 of each example described above, the purge pump 30 is configured to prevent the liquid fuel from intruding into the motor part 36 through the pump part 32. In each of the first and second examples, the housing 34 of the pump part 32 defines therein the liquid storage part 34*s* for reserving the liquid fuel such that the liquid storage part 34*s* is located below the flow passages 34*f* formed along the circumferential edges of the impeller 33. If the purge pump 30 does not have the liquid storage part 34*s*, when the liquid fuel flows into the housing 34 of the pump part 32, the liquid fuel may move along the impeller 33 and the output shaft 37 of the motor part 36 into the motor part 36. However, in each of the first and second examples, the housing 34 of the purge pump 30 includes the liquid storage part 34*s* positioned below the flow passages 34*f*, which are formed along the outer circumferential edge of the impeller 33. Thus, when the liquid fuel flows into the housing 34 of the pump part 32, the liquid fuel remains in the liquid storage part 34*s* and does not intrude into the motor housing 39 via the output shaft 37. Accordingly, when a part of the fuel vapor becomes liquid in the purge passage 26, the liquid fuel does not intrude into the motor part 36 from the pump part 32 of the purge pump 30, thereby preventing a failure of the purge pump 30. In addition, because the purge pump 30 is placed in the engine room of the vehicle, the liquid fuel stored in the liquid storage part 34*s* can be vaporized due to heat of the engine 14.

Further, in the third example shown in FIG. 6, the motor part 36 of the purge pump 30 is located above the pump part 32. Thus, when the liquid fuel flows into the pump part 32, the liquid fuel does not intrude into the motor part 36 due to the gravity. In the fourth example shown in FIG. 7, the pump inlet 32*e* of the purge pump 30 is directed downward. The end of the purge passage 26, which is connected to the pump inlet 32*e*, is directed upward. Because the liquid fuel does not flow through the purge passage 26 against the gravity, the liquid fuel does not reach the pump part 32 of the purge pump 30. In each of the fifth and sixth examples shown in FIGS. 8 and 9, respectively, the purge pump 30 has the inflow chamber 34*x* and the introduction passage 34*z*. The inflow chamber 34*x* communicates with the pump inlet 32*e*, and the introduction passage 34*z* is configured to introduce the fuel vapor from the upper section of the inflow chamber 34*x* into the flow passages 34*f* of the pump part 32. Thus, when the liquid fuel flows into the inflow chamber 34*x* together with the fuel vapor, the liquid fuel remains in the inflow chamber 34*x*, whereas the fuel vapor flows into the introduction passage 34*z* from the upper section of the inflow chamber 34*x*. Accordingly, the intrusion of the liquid fuel into the motor part 36 can be prevented. In addition, the purge pump 30 is placed in the engine room of the vehicle, the liquid fuel stored in the inflow chamber 34*x* can be vaporized due to heat of the engine 14.

Figure 10:
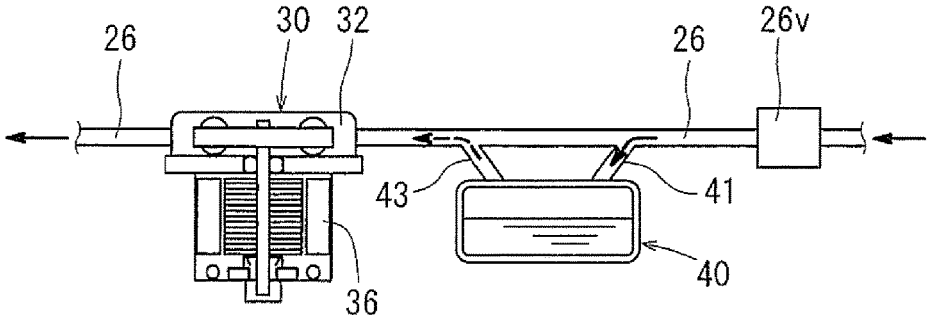
FIG. 10 is a schematic diagram of a part of the fuel vapor recovery apparatus in a seventh example.

The fuel vapor recovery apparatus 20 in a seventh example will be described in reference to FIG. 10. As viewed in FIG. 10, the fuel vapor recovery apparatus 20 has a liquid reservoir 40 for storing the liquid fuel at a position between purge valve 26*v* and the purge pump 30 and below the purge passage 26 such that the liquid fuel produced in the purge passage 26 is introduced into the liquid reservoir 40. The purge passage 26 has a first communication pipe 41 branched from the purge passage 26 downstream of the purge valve 26*v* and a second communication pipe 43 branched from the purge passage 26 upstream of the purge pump 30. The first communication pipe 41 and the second communication pipe 43 are connected to the liquid reservoir 40, so that the liquid fuel produced in the purge passage 26 flows through the first communication passage 41 into the liquid reservoir 40. Thus, the liquid fuel does not flow into the pump part 32 of the purge pump 30 directly. Further, the liquid reservoir 40 is made from a material having high thermal conductivity such as metal such that the liquid reservoir 40 can efficiently absorb heat within the engine room. Therefore, the liquid fuel stored in the liquid reservoir 40 can vaporize due to heat in the engine room, and then the vaporized fuel, i.e., the fuel vapor is returned to the purge passage 26 via the second communication pipe 43 and is delivered to the intake passage 16 of the engine 14 by action of the purge pump 30. Accordingly, the liquid fuel stored in the liquid reservoir 40 can be effectively used.

Figure 11:
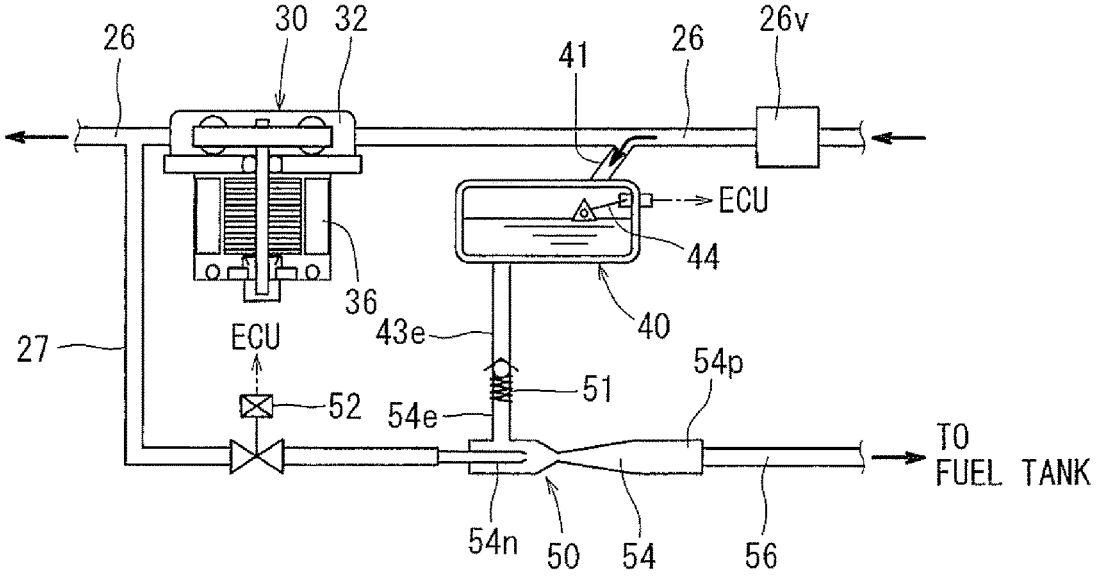
FIG. 11 is a schematic diagram of a part of the fuel vapor recovery apparatus in an eighth example.

The fuel vapor recovery apparatus 20 in an eighth example has a fuel return device 50 for returning the liquid fuel from the liquid reservoir 40 to the fuel tank 15 as viewed in FIG. 11. The fuel return device 50 has an ejector 54 configured to jet a first fluid from a nozzle 54*n* for creating negative pressure around the nozzle 54*n*, to draw a second fluid from an inlet 54*e* due to the negative pressure, and to discharge a mixed fluid of the first fluid and the second fluid from an outlet 54*p*. The inlet 54*e* of the ejector 54 is connected with a liquid drain pipe 43*e*, which has a check valve 51 and is communicated with a bottom section of the liquid reservoir 40. The nozzle 54*n* of the ejector 54 is connected with a branch pipe 27, which is branched from the purge passage 26 downstream of the purge pump 30 and has a solenoid valve 52. The outlet 54*p* of the ejector 54 is connected with a return pipe 56 communicating with the fuel tank 15. The liquid reservoir 40 is equipped with a level meter 44 for measuring a liquid level of the liquid fuel in the liquid reservoir 40. Here, the level meter 44 and the solenoid valve 52 are electrically connected to the ECU 19.

When the ECU 19 detects the liquid level of the liquid fuel above a predetermined value based on signals output from the level meter 44, the ECU 19 opens the solenoid valve 52 under a condition that the purge pump 30 is driven. Thus, a part of mixed gas of the fuel vapor and the air, which are pumped toward the intake passage 16 of the engine 14 by the purge pump 30, is supplied to the nozzle 54*n* of the ejector 54 via the branch pipe 27. As a result, negative pressure is generated around the nozzle 54*n* and is applied to the inlet 54*e* of the ejector 54, so that the liquid fuel stored in the liquid reservoir 40 is drawn into the inlet 54*e* of the ejector 54 via the liquid drain pipe 43*e* and the check valve 51. The liquid fuel is discharged from the outlet 54*p* of the ejector 54 together with the mixed gas of the fuel vapor and the air, which is jetted from the nozzle 54*n*, and thus is returned to the fuel tank 15 via the return pipe 56.

Figure 12:
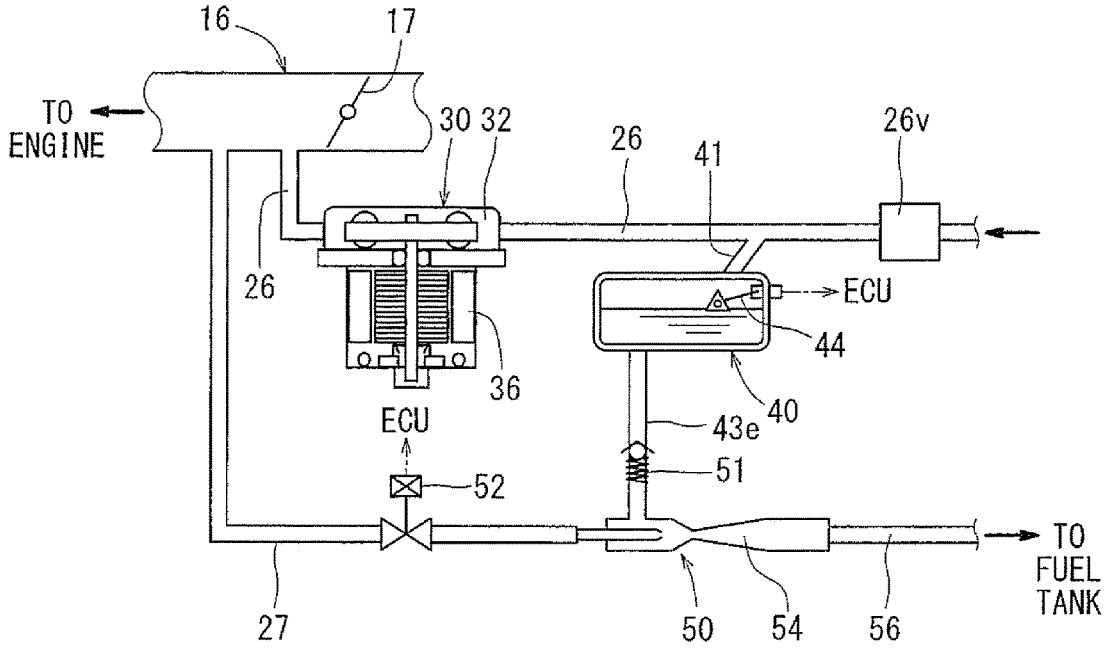
FIG. 12 is a schematic diagram of a part of the fuel vapor recovery apparatus in a ninth example.

In the eighth example, the mixed gas of the fuel vapor and the air is supplied to the nozzle 54*n* of the ejector 54 through the branch pipe 27 branched from the purge passage 26 downstream of the purge pump 30. FIG. 12 shows a part of the fuel vapor recovery apparatus 20 in a ninth example in which the branch pipe 27 is branched from the intake passage 16 of the engine 14 and extends to the ejector 54. Thus, the air and the like are supplied from the intake passage 16 of the engine 14 through the branch pipe 27 to the nozzle 54*n* of the ejector 54.

In each of the seventh to the ninth examples, because the liquid reservoir 40 for storing the liquid fuel is provided between the purge valve 26*v* and the purge pump 30, the liquid fuel produced in the purge passage 26 does not enter the pump part 32 of the purge pump 30. In addition, the liquid fuel stored in the liquid reservoir 40 can be changed to the fuel vapor due to heat generated by the engine 14 and/or can be returned to the fuel tank 15 by the fuel return device 50, so that the liquid fuel stored in the liquid reservoir 40 can be used effectively.

This disclosure is not limited to the above-described examples and can be modified without departing from the scope of the invention. For example, the fuel vapor recovery apparatus 20 including the liquid storage part 34*s* or the inflow chamber 34*x* can be equipped with a vaporization mechanism for vaporizing the liquid fuel stored in the liquid storage part 34*s* or in the inflow chamber 34*x* due to the heat generated by the engine 14 and/or a return mechanism for returning the liquid fuel to the fuel tank 15. With respect to the seventh to ninth examples, the liquid reservoir 40 can be provided with a heater for vaporizing the liquid fuel stored in the liquid reservoir 40. The fuel vapor recovery apparatus 20 can be equipped with a sealing member between the pump part 32 and the motor part 36 of the purge pump 30 for preventing the liquid fuel from entering the motor part 36 instead of the above-described configurations.

The invention claimed is:

1. A fuel vapor recovery apparatus for a vehicle having a fuel tank and an engine, the fuel vapor recovery apparatus comprising:

an adsorbent canister adapted to capture fuel vapor produced in the fuel tank;

a purge passage connecting the adsorbent canister to an intake passage of the engine for a flow of fuel vapor;

a purge pump provided along the purge passage, through which the fuel vapor flows, and adapted to deliver the fuel vapor from the adsorbent canister to the intake passage, the purge pump having a pump part and a motor part, the motor part being configured to drive the pump part; and a prevention mechanism configured to prevent liquid fuel liquefied from the fuel vapor in the purge passage from entering the motor part through the pump part;

wherein the pump part includes a housing and an impeller;

wherein the housing defines a flow passage and an inlet, wherein the flow passage is in communication with the purge passage via the inlet;

wherein the impeller is configured to rotate about a rotational axis within the housing to flow the fuel vapor through the flow passage, wherein the flow passage extends about the rotational axis;

wherein the prevention mechanism includes a liquid storage part defined in the housing that is in communication between the inlet and the flow passage;

wherein the liquid storage part is configured to reserve the liquid fuel; and wherein the liquid storage part is located on an upstream side of the impeller, vertically below the flow passage, and extends beyond the inlet in a radial direction from the rotational axis.

2. The fuel vapor recovery apparatus according to claim 1, wherein the purge pump is placed in an engine room of the vehicle.

3. The fuel vapor recovery apparatus according to claim 1, wherein the flow passage extends along an outer circumferential edge of the impeller.

4. The fuel vapor recovery apparatus according to claim 1, wherein the liquid storage part is immediately radially adjacent the impeller.

5. The fuel vapor recovery apparatus according to claim 4, wherein the liquid storage part extends vertically below each of the inlet and the impeller.

6. A fuel vapor recovery apparatus for a vehicle having a fuel tank and an engine, the fuel vapor recovery apparatus comprising:

an adsorbent canister adapted to capture fuel vapor produced in the fuel tank;

a purge passage connecting the adsorbent canister to an intake passage of the engine for a flow of fuel vapor;

a purge pump provided along the purge passage, through which the fuel vapor flows, and adapted to deliver the fuel vapor from the adsorbent canister to the intake passage, the purge pump having a pump part and a motor part, the motor part being configured to drive the pump part; and a prevention mechanism configured to prevent liquid fuel liquefied from the fuel vapor in the purge passage from entering the motor part through the pump part;

wherein the pump part includes an inlet connected with the purge passage, and an impeller configured to rotate about a rotational axis to flow fuel vapor through a flow passage defined in the pump part that extends about the rotational axis;

wherein the flow passage is in communication with the inlet in a radial direction from the rotational axis via an introduction passage;

wherein the prevention mechanism includes an inflow chamber formed at the inlet of the pump part at a position on an upper side of the motor part;

wherein the introduction passage extends radially inward from an upper section of the inflow chamber to the flow passage with respect to the rotational axis;

wherein the introduction passage is immediately radially adjacent the flow passage with respect to the rotational axis; and wherein the inflow chamber is disposed vertically below the inlet and the introduction passage.

7. The fuel vapor recovery apparatus according to claim 6, wherein the purge pump is placed in an engine room of the vehicle.

8. A fuel vapor recovery apparatus for a vehicle having a fuel tank and an engine, the fuel vapor recovery apparatus comprising:

an adsorbent canister adapted to capture fuel vapor produced in the fuel tank;

a purge passage connecting the adsorbent canister to an intake passage of the engine for a flow of fuel vapor;

a purge pump provided along the purge passage, through which the fuel vapor flows, and adapted to deliver the fuel vapor from the adsorbent canister to the intake passage, the purge pump having a pump part and a motor part, the motor part being configured to drive the pump part;

a prevention mechanism configured to prevent liquid fuel liquefied from the fuel vapor in the purge passage from entering the motor part through the pump part;

wherein the purge passage includes a purge valve between the adsorbent canister and the purge pump, wherein the prevention mechanism includes a liquid reservoir provided at the purge passage between the purge valve and the purge pump, and wherein the liquid reservoir is configured to reserve the liquid fuel produced in the purge passage, and a return passage connected between the liquid reservoir and the fuel tank separately from the adsorbent canister and the purge valve.

9. The fuel vapor recovery apparatus according to claim 8, wherein the liquid reservoir is placed in an engine room of the vehicle.

10. The fuel vapor recovery apparatus according to claim 8, wherein the liquid reservoir is metal.

* * * * *